United States Patent [19]

Takamura

[11] 4,398,380

[45] Aug. 16, 1983

[54] PACKING APPARATUS

[75] Inventor: Yoshiyuki Takamura, Nagoya, Japan

[73] Assignee: Fuji Pack System Ltd., Japan

[21] Appl. No.: 148,069

[22] Filed: May 12, 1980

[30] Foreign Application Priority Data

Oct. 17, 1979 [JP] Japan ..... 54-134830

[51] Int. Cl.[3] ..... B65B 45/00; B65B 47/10; B65B 67/08

[52] U.S. Cl. ..... 53/390; 53/559; 53/578

[58] Field of Search ..... 53/390, 427, 453, 509, 53/578, 511, 559

[56] References Cited

U.S. PATENT DOCUMENTS

| | | | |
|---|---|---|---|
| 2,934,867 | 5/1960 | Vogt | 53/453 |
| 3,010,262 | 11/1961 | Rumsey, Jr. | 53/433 |
| 3,211,190 | 10/1965 | Vogt | 53/436 X |
| 3,347,011 | 10/1967 | Lovas et al. | 53/453 X |
| 3,792,181 | 2/1974 | Mahaffy et al. | 53/511 X |
| 3,950,919 | 4/1976 | Perdue | 53/453 X |

FOREIGN PATENT DOCUMENTS

| | | | |
|---|---|---|---|
| 633694 | 12/1949 | United Kingdom | 53/559 |

*Primary Examiner*—Nicholas P. Godici
*Assistant Examiner*—Charles L. Willis
*Attorney, Agent, or Firm*—John E. Benoit

[57] ABSTRACT

Disclosed herein is a packing apparatus which comprises a container opening at its upper end and at least one film suction chamber positioned under the container and is connected to an appropriate absorbing device. The container defines a packing chamber for holding a part of a packing film in a baggy shape and receiving products to be packed therein. The suction chamber defines a chamber communicating with the absorbing device. The chamber further communicates with the packing chamber through a plurality of vent holes for creating a partial vocuum under the packing film.

5 Claims, 12 Drawing Figures

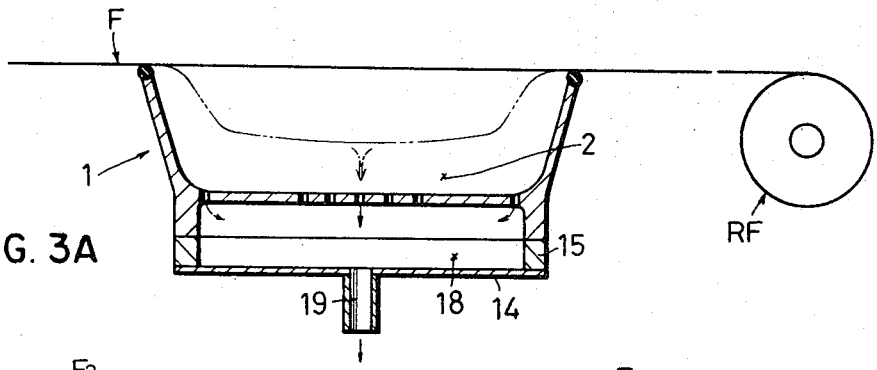
FIG. 3A
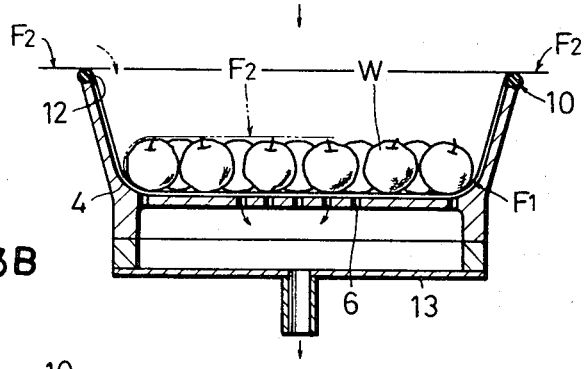
FIG. 3B
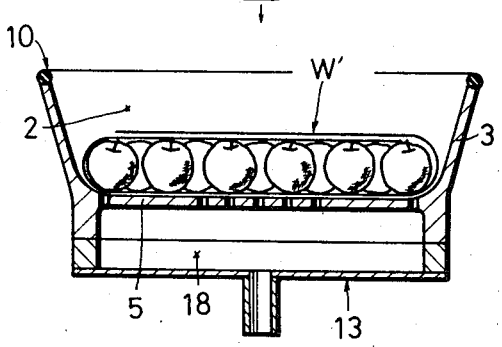
FIG. 3C
FIG. 4
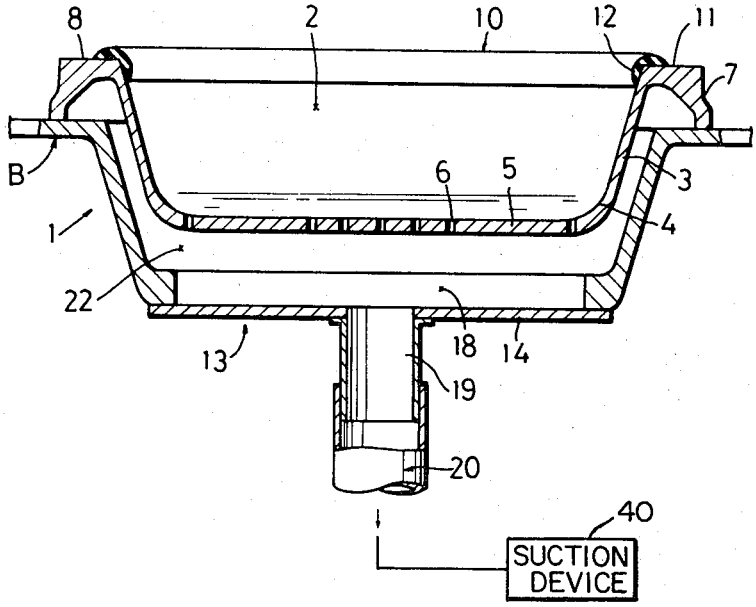

PACKING APPARATUS

BACKGROUND OF THE INVENTION

1. Field of the Invention

The present invention relates to an apparatus for packing products in a wrapping film including an aluminum foil, and more particularly, it relates to a novel and improved packing apparatus in which the products to be wrapped are put in an extended film of predetermined size formed and held in a baggy shape by suction in a packing chamber.

2. Description of the Prior Art

In a conventional packing apparatus, there is provided an auxiliary means such as a tray in which a predetermined amount of products such as vegetables and fruits are put and every tray holding the products is wrapped by a film. Such an apparatus is uneconomical since the trays are wasted after use.

In another type of conventional packing apparatus in which the aforementioned tray is not utilized, the products should be manually wrapped in a film severed in predetermined size and extended on a flat bed. In this case, the film is manually folded along the products. Such an apparatus takes time and requires much labor, and further, the products cannot be accurately packed.

SUMMARY OF THE INVENTION

It is the object of the present invention to provide a packing apparatus capable of effectively packing products which are irregular in size and instable such as vegetables and fruits without utilizing any trays.

According to the present invention, there is provided a packing apparatus comprising a container, a packing chamber and at least one suction chamber. A sheet of wrapping film severed in predetermined size is extendedly set on the upper open end of the packing chamber and is downwardly displaced by the suction chamber within the chamber along the inner surface thereof to form a baggy portion in which the products are put, and thereafter the edges of the film are folded in order to completely pack the products. According to the present invention, the baggy portion of the wrapping film is securely held within the packing chamber by suction, and the products put in the baggy portion are effectively packed without necessity of turning round, raising or gathering the same. Therefore, the products which are irregular in size and shape and instable such as vegetables and fruits can be effectively packed even if the products are separately supplied.

BRIEF EXPLANATION OF THE DRAWINGS

FIGS. 3(A), 3(B) and 3(C) are cross sectional views illustrating operation of the apparatus of FIG. 1;

FIG. 4 is a cross sectional view showing a modification of the embodiment of FIG. 1;

DESCRIPTION OF THE PREFERRED EMBODIMENTS

Figure 1:
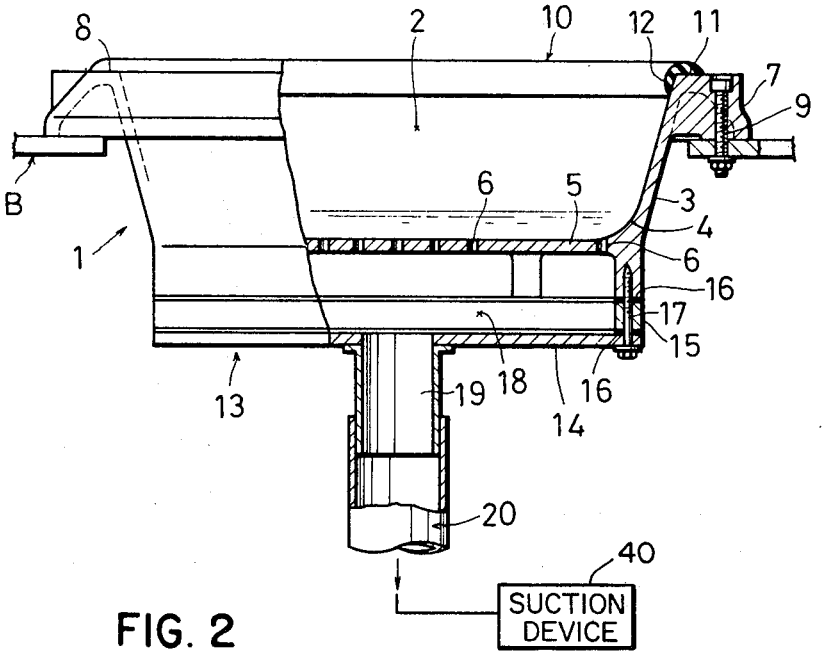
FIG. 1 is a partially fragmentary front elevational view of a packing apparatus embodying the present invention.
Figure 2:
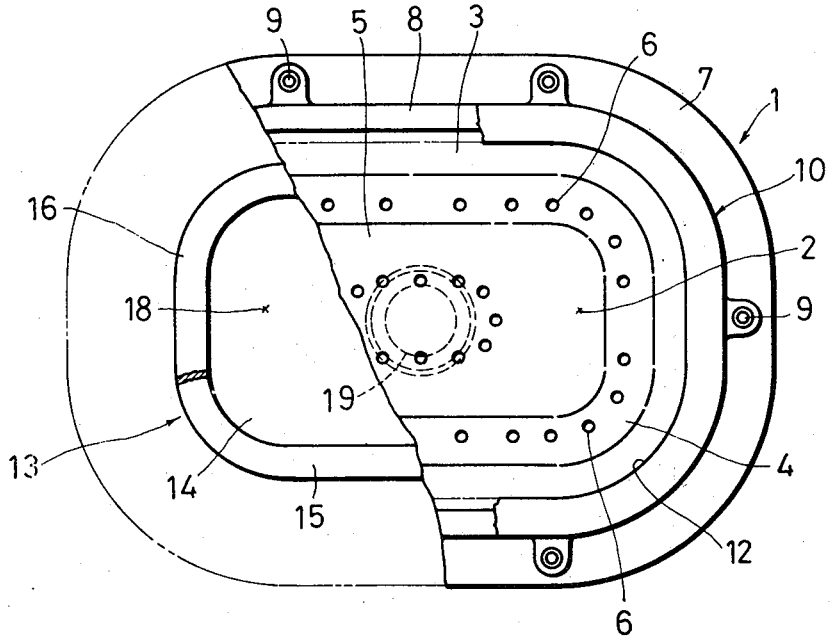
FIG. 2 is a partially fragmentary top plan view of the apparatus of FIG. 1.

Referring now to FIGS. 1 to 3 of the drawings in which a first embodiment of the present invention is shown, numeral 1 indicates a container which is sealingly provided in its lower portion with a detachable suction chamber 13. The container 1 is provided in the form of an oblong vessel opening at the upper end and defines a packing chamber 2 of appropriate capacity. The container 1 comprises a substantially conical peripheral wall 3, a curved guide portion 4 and a base plate 5 connected with the peripheral wall 3 through the guide portion 4, and a plurality of vent holes 6 are provided in the center of the base plate 5 and the circumference of the guide portion 4. A flange 7 extends from the upper end of the peripheral wall 3, and a holding ring 10 for a film is replaceably mounted on a seat 8 defined by the upper surface of the flange 7. The container 1 thus constructed is mounted to a frame B of the packing apparatus through the flange 7 of the peripheral wall 3 and a bolt 9.

The holding ring 10 is adapted to receive an extended film of predetermined size while preventing the same from slipping off, and is made of material such as rubber and soft synthetic resin having frictional resistance against the film, and is placed so that a concave portion 11 is engaged with the seat 8 and the inner end thereof extends downwardly in contact with the upper inner surface of the peripheral wall 3 as a holding end 12. By virtue of provision of this holding end 12, frictional force in forming of the extended film in a baggy shape, i.e., holding force is effectively used so that the flm is held in a good condition to be accurately formed in a baggy shape.

On the other hand, suction chamber 13 comprises a cover 14 and a ring-shaped wall 15 and is made in the form of a cap which fits in size and shape with the container 1. The suction chamber 13 is secured to the lower surface of the peripheral wall 3 by a bolt 17 through a sealing member 16 so that an air space 18 defined between the suction chamber 13 and the base plate 5 communicates with an suction device 40 through a mouth 19 of the cover 14 and a duct 20 and with the packing chamber 2 through the vent holes 6.

The packing apparatus thus constructed is rather suited for manual operation, though, it may of course be utilized as an automatic apparatus. In either case, products can be packed without provision of trays therefor.

In operation, a sheet of film F severed in predetermined length is drawn from a rolled film RF to cover the container 1 and is extendedly held by the holding ring 10 as shown in FIG. 3(A). In this condition, suction device 40 is driven to operate the suction chamber 13 so that the extended film F is downwardly absorbed within the packing chamber 2 as shown in two-dot line in FIG. 3(A) while four edges thereof are in close contact with the holding ring 10. The film F is continuously contained along the inner surface of the packing chamber 2 to be in close contact with the base plate 5 through the vent holes 6 as shown in FIG. 3(B) to form a baggy portion F1, which is adapted to receive a predetermined number of products to be wrapped W. Thereafter edges F2 of the film F held by the holding ring 10 are folded in order and pasted with each other to form a wrapped package W' which can be taken up from the container 1 as shown in FIG. 3(C).

When products such as cucumbers and carrots which are long in comparison with round products such as apples and oranges are packed by the packing apparatus of the present invention, it is preferable to arrange the products in rows with respect to the longitudinal direction thereof. In any case, the products such as vegetables and fruits may be separately put in the packing chamber 2 and held therein to be effectively packed without necessity of any trays.

Since the edges F2 of the film F are effectively held by the holding end 12 of the holding ring 10 and are prevented from slipping off when the baggy portion F1 is formed in the packing chamber 2, the film F is accurately formed and held in the shape of a bag without being loosened so as to conduct satisfactory packing.

The absorption holder 13 may be in the form of a box in section to define the bottom of the packing chamber 2 by the upper plate thereof.

In this embodiment, the frame B may have a hollow portion 22, of which bottom functions as the suction chamber 13 so that the hollow portion 22 detachably receives the container 1 (see FIG. 4).

Figure 5:
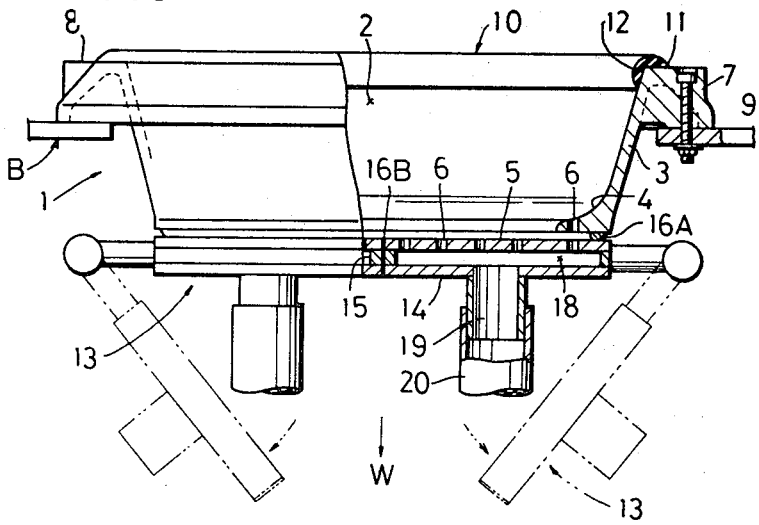
FIG. 5 is a partially fragmentary front elevational view of a second embodiment of the present invention.
Figure 6:
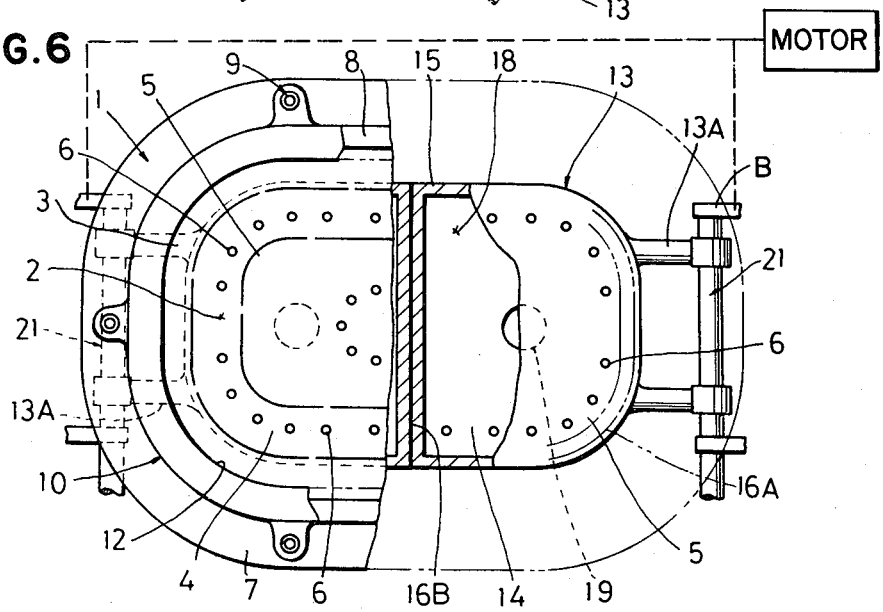
FIG. 6 is a partially fragmentary top plan view of the apparatus of FIG. 5.
Figure 7:
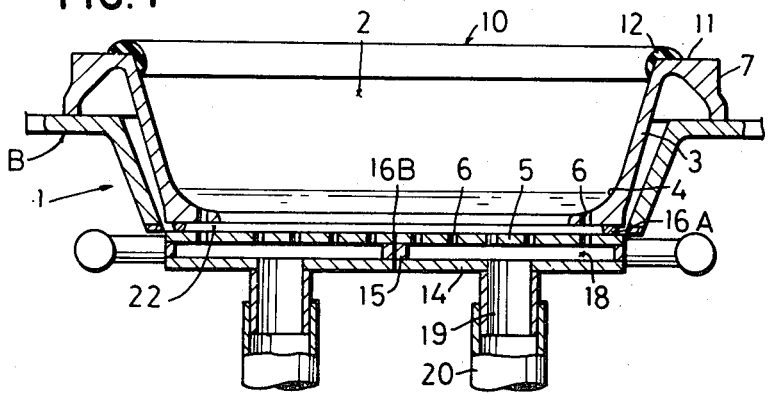
FIG. 7 is a cross sectional view showing a modification of the second embodiment.

Attention is now drawn to FIGS. 5 to 7 in which a further embodiment of the present invention is shown. In this embodiment, there are provided under the container 1 a pair of suction chambers 13 which are downwardly pivotable as shown in two-dot lines in FIG. 5. The container 1 is identical with that in the first embodiment and defines the guide portion 4 in the lower inner end of the peripheral wall 3 thereof. The lower portion of the packing chamber 2 is fully opened.

The suction chambers 13 are semicircular plates which are conformed to the container 1, and the upper plates thereof are provided with a plurality of vent holes 6 and define the base plate 5 of the packing chamber 2. The outer ends of the suction chambers 13 are connected through arms 13A to rotating shafts 21 which are supported by the frame B to pivotally move between close positions in which the holders 13 horizontally contact with each other and open positions in which the holders 13 are downwardly inclined.

The chambers 13 communicate with a common vacuum device, such as device 40 of FIG. 1, through flexible pipes 20. When in the closed positions, the chambers 13 are kept in contact with the container 1 in an airtight manner by a seal ring 16A provided in the lower surface of the container 1 and another seal ring 16B interposed between the chambers 13. With respect to a means for opening and closing the chambers 13, a rod of a cylinder linked with arms connected to the rotating shafts 21 or a shaft connected to a motor and linked through bevel gears with the rotating shafts 21 may be employed.

The packing apparatus of this embodiment is rather suited for automatic operation, though, it may of course be utilized as a manually operated apparatus under the condition that the chambers 13 are kept in close contact with each other. After the packing operation is completed, the suction chambers 13 are opened by a means such as a push button to downwardly discharge the wrapped package W'.

In this embodiment, the chambers 13 may be formed by a plate which can be downwardly inclined and functions as a chute for discharging the wrapped package W'.

In this embodiment, further, the frame B may have a hollow portion 22, of which bottom is separated in two to function as the downwardly pivotable vacuum chambers 13 so that the hollow portion 22 detachably receives the container 1 (see FIG. 7).

Figure 8:
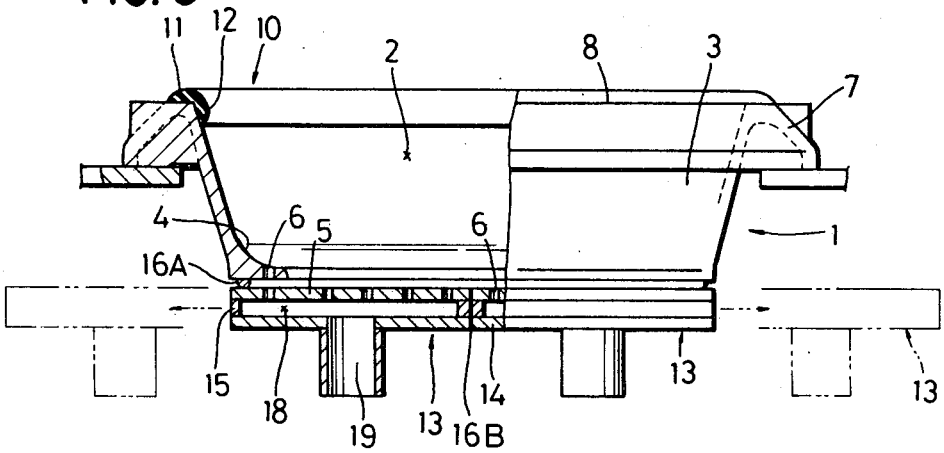
FIG. 8 is a partially fragmentary front elevational view of a third embodiment of the present invention.
Figure 9:
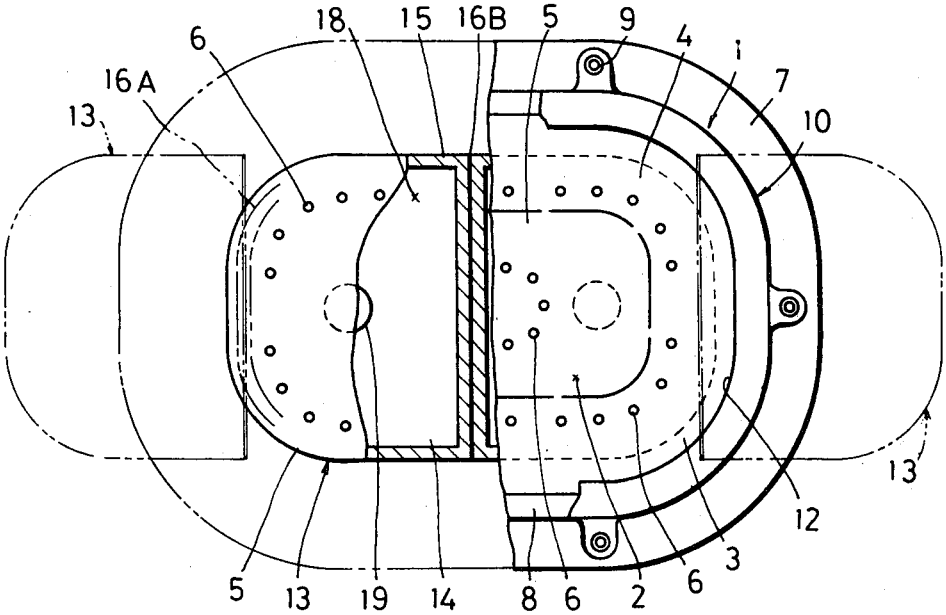
FIG. 9 is a partially fragmentary top plan view of the apparatus of FIG. 8.
Figure 10:
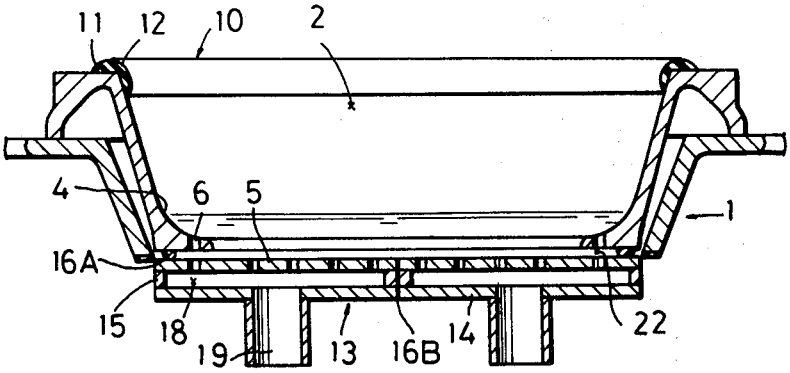
FIG. 10 is a cross sectional view showing a modification of the third embodiment.

In another embodiment of the present invention as shown in FIGS. 8 to 10, there are provided under the container 1 a pair of vacuum chambers 13 which are horizontally slidable, and the products packed under the condition that the chambers 13 are closed, and the products are downwardly discharged by opening of the chambers 13.

With respect to means for guiding sliding movement of the chambers 13, accurate guiding means such as a roller and a rail, a projection and a slit and a shaft and a bearing may be linked to an appropriate driving means for opening and closing the chambers 13. Further, the holders 13 may be formed by a plate which is horizontally slidable.

In this embodiment, the frame B may have a hollow portion 22, of which bottom is separated in two to function as the horizontally slidable vacuum chambers 13 so that the hollow portion 22 detachably receives the container 1 (see FIG. 10).

The chambers 13 in the second and the third embodiments may be made swingable. Further, when the packing apparatus according to the present invention as shown in the second and the third embodiments is utilized as an automatic apparatus, it may be vertically movable and may be provided with a mechanism comprising a means for adjusting the dimensions of the packing chamber 2 which is connected to a rod of a cylinder provided outwardly of the packing chamber 2.

While the invention has been described with reference to a few preferred embodiments thereof, it is to be understood that modifications or variations may be easily made without departing from the scope of this invention which is defined by the appended claims.

What is claimed is:

1. Apparatus for packaging items with a unitary wrapping film comprising a package chamber having an upper opening and a base opening;

a pair of suction chambers;

means for mounting said pair of suction chambers adjacent said bottom opening;

means for moving said pair of suction chambers so as to close and open said base opening so as to form said wrapper film when closed and dispense said film containing said items when open;

a plurality of vent holes in said suction chambers;

a holding ring replaceably mounted about the edge of said upper opening in said package chamber said holding ring being of a material which frictionally retains a sheet of said wrapping film without additional retaining means; and suction means connected to said suction chambers for drawing the central area of said film into said package chamber when said suction chambers are in a closed position and while said film is being peripherally frictionally retained by said holding ring.

2. The apparatus of claim 1 wherein said means for mounting said pair of suction chambers comprises arms extending outwardly from each of said suction chambers; and rotatable shafts secured to each of said arms whereby said suction chambers are pivotally movable about the axis of said shafts.

3. The apparatus of claim 1 wherein said means for mounting said pair of suction chambers comprises a substantially horizontal guide for retaining said suction chambers whereby said suction chambers are slideably opened and closed.

4. The apparatus of claim 1 further comprising first sealing means between each of said suction chambers and said package chamber when said suction chambers are in said closed position; and second sealing means between each of said suction chambers when said suction chambers are in a closed position.

5. The apparatus of claim 1 further comprising motor means coupled to said means for moving said pair of suction chambers.

* * * * *